US007231854B2

(12) United States Patent
Kikuchi

(10) Patent No.: US 7,231,854 B2
(45) Date of Patent: Jun. 19, 2007

(54) CONNECTED-SCREW DRIVER

(75) Inventor: Noriaki Kikuchi, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/411,817

(22) Filed: Apr. 27, 2006

(65) Prior Publication Data

US 2006/0243106 A1 Nov. 2, 2006

(30) Foreign Application Priority Data

Apr. 28, 2005 (JP) ..... P2005-131407

(51) Int. Cl.
*B25B 23/06* (2006.01)

(52) U.S. Cl. ..... 81/434; 227/136

(58) Field of Classification Search ..... 81/431, 81/433, 434, 435, 57.37; 227/135, 136
See application file for complete search history.

(56) References Cited

U.S. PATENT DOCUMENTS 7,082,857 B1 * 8/2006 Hoffman ..... 81/57.16
7,165,481 B2 * 1/2007 Kikuchi ..... 81/434

FOREIGN PATENT DOCUMENTS

JP 57-61477 4/1982
JP 10-34553 2/1998

* cited by examiner

*Primary Examiner*—Jacob K. Ackun, Jr.
(74) *Attorney, Agent, or Firm*—Mattingly, Stanger, Malur & Brundidge, P.C.

(57) ABSTRACT

To provide a connected-screw driver capable of stably retaining a screw, which has just come off from a screw connecting belt, and constantly tightening the resultant screw in a tightening position. A connected-screw driver having a driver unit provided with a motor, an output shaft, a housing, and a bit mounted to the output shaft, a slider case mounted to the housing to permit the bit to be inserted therethrough, and a slider 7 provided in the slider case to be able to reciprocate therein and having an engagement member 20*a* adapted to abut against a member being tightened, the slider feeding connected screws as the slider reciprocates, and wherein the slider 7 is provided with a chuck mechanism 18 that is movable in an axial direction of the bit and temporarily retains a screw, which has come off from a screw connecting belt, until the screw abuts against a member being tightened, and a regulating mechanism 19 that regulates and fixes a position of the chuck mechanism 18 in the axial direction of the bit.

4 Claims, 9 Drawing Sheets

20b
22a
22
20
21
101
4
W2

CONNECTED-SCREW DRIVER

BACKGROUND

1. Technical Field

The present invention relates to a connected-screw driver adapted to drive screws, which are connected to a screw connecting belt, into a member to be tightened while feeding the screw connecting belt at a predetermined distance at a time in accordance with a screw tightening operation.

2. Description of Related Art

This kind of connected-screw driver is used for an operation for fixing by driving a gypsum board with a screw into a ground material, such as timber and a steel material. This connected-screw driver is provided with a screw feed mechanism for feeding the screw connecting belt a little by little in accordance with screw tightening operations. This screw feed mechanisms includes a cylindrical slider case fixed to a housing, a slider provided reciprocating movably in the slide case, a spring urging the slider toward a position away from the housing, and a drum rotated in accordance with the reciprocating movements of the slider so as to feed the screws intermittently.

When the driver body is pushed during a screw tightening operation with a front end thereof pressed against the member to be tightened, the bit and a screw, which are first separated from each other, come into engagement with each other, so that the screw comes off from the connecting belt due to the pressing force of the bit. The screw and bit are thereafter moved forward together, and the screw impinges upon the member to be tightened, to cause the same member to be tightened.

The behavior of the screw just coming off from the screw connecting belt is unstable, and the screw readily deviates from the bit until the screw impinges upon the member to be tightened. Consequently, in some cases, a screw-tightening position is shifted, or the screw is tightened diagonally.

Under the circumstances, various kinds of proposals to solve these problems have been made (refer to, for example, JP-A-57-061477 and JP-A-10-034553).

JP-A-57-061477 discloses a structure provided with a pair of spring-biased symmetrically formed chuck members, on which screws coming off from a strip (screw connecting belt) are retained.

JP-A-10-034553 discloses a structure provided on a feeder box (slider) with a stopper base, which engages with a member to be tightened, in such a manner that a position of the stopper base in the screw tightening direction can be varied, the structure being thereby capable of being operated for screws of various lengths.

SUMMARY

In the structure disclosed in JP-A-57-061477, the chuck member is provided in a position far away from the strip.

Therefore, there is the possibility that, when a short screw is used, the screw moves ahead of a bit with a force occurring when the screw comes off the strip, and that the screw is removed from the bit.

In the structure disclosed in JP-A-10-034553, a screw grasping structure is not provided. Therefore there is the possibility that a screw tightening position is shifted, and that the screw is tightened diagonally.

The present invention has been made in view of these problems, and an object thereof is to provide a connected-screw driver capable of stably retaining a screw which has just come off from a screw connecting belt and constantly and correctly tightening the resultant screw in a tightening position.

To achieve this object, the invention defined in claim 1 provides a connected-screw driver having a driver unit provided with a motor, an output shaft rotated by the motor, a housing adapted to house these motor and output shaft, and a bit fixed to the output shaft, a slider case fixed to the housing so that the bit is inserted therethrough, and a slider provided in the slider case so that the slider can be moved reciprocating therein; an engagement member adapted to be engaged with a member to be tightened; and adapted to feed the connected screws in accordance with the reciprocating movements of the slider, characterized in that:

the slider is provided with a chuck mechanism, which is adapted to temporarily retain a screw, which has come off from the screw connecting belt, until the screw has been engaged with the member to be tightened, in such a manner that the slider can be moved in the axial direction of the bit; and a regulating mechanism adapted to regulate and fix a position of the chuck mechanism in the axial direction of the bit.

The invention defined in Claim 2 is according to that defined in Claim, wherein the chuck mechanism is formed so as to include a base held on the slider so that the base can be moved in the axial direction of the bit, a pair of chucks engageable with a screw and provided pivotably on both sides of the axis of the bit, and a first elastic member urging each chuck in the direction in which the chucks engage with screws.

The invention defined in Claim 3 is according to that defined in Claim 2, wherein the chuck mechanism is provided with fall of screw preventing plates on the portions of the chuck mechanism which are adjacent to the chucks thereof.

The invention defined in Claim 4 is according to that defined in Claim 1 or 2, wherein the regulating mechanism is formed so as to include an operating member supported on the slider so that the operating member can be reciprocating moved, and having an engagement projection engageable selectively with one of a plurality of engagement recesses formed in the base of the chuck mechanism, and a second urging member adapted to urge the operating member in the direction in which the engagement projection of the operating member comes into engagement with one of the engagement recess of the base.

When the position of the chuck mechanism according to the invention defined in Claim 1 is regulated by the regulating mechanism so that the chuck mechanism is positioned in the vicinity of a front end portion of a screw held on the screw connecting belt, a screw which has just come off from the screw connecting belt, and which is in an unstable condition can be tightened after the behavior of the screw has been stabilized by temporarily holding this screw by the chucks. Therefore, the inconveniences including the shifting of the tightening position of a screw and the occurrence of a diagonally tightened screw are prevented. Accordingly, the screws can be tightened correctly in predetermined tightening positions at all times, and the screw tightening operation is excellently finished.

According to the invention defined in Claim 2, the chucks of the chuck mechanism engages with a screw and move pivotally (open) against the urging force of the first elastic member to cause a distance between the chucks to be automatically varied. This enables screws of various diameters of stems and heads to be held firmly, and the behavior of the screws to be stabilized.

According to the invention defined in Claim 3, a fall of a screw which has just come off from the screw connecting belt is prevented, and such a screw is held reliably at all times. Therefore, the stabilization of the behavior of the screw can be further improved.

According to the invention defined in Claim 4, the position of the chuck mechanism can be regulated suitably in accordance with the length of a screw by working the operating member of the regulating mechanism against the urging force of the second urging member. This enables the behavior of screws of various lengths which have just come off from the screw connecting belt to be stabilized.

DESCRIPTION OF THE EMBODIMENTS

A mode of embodiment of the present invention will now be described on the basis of the attached drawings.

<Mode of Embodiment 1>

Figure 1:
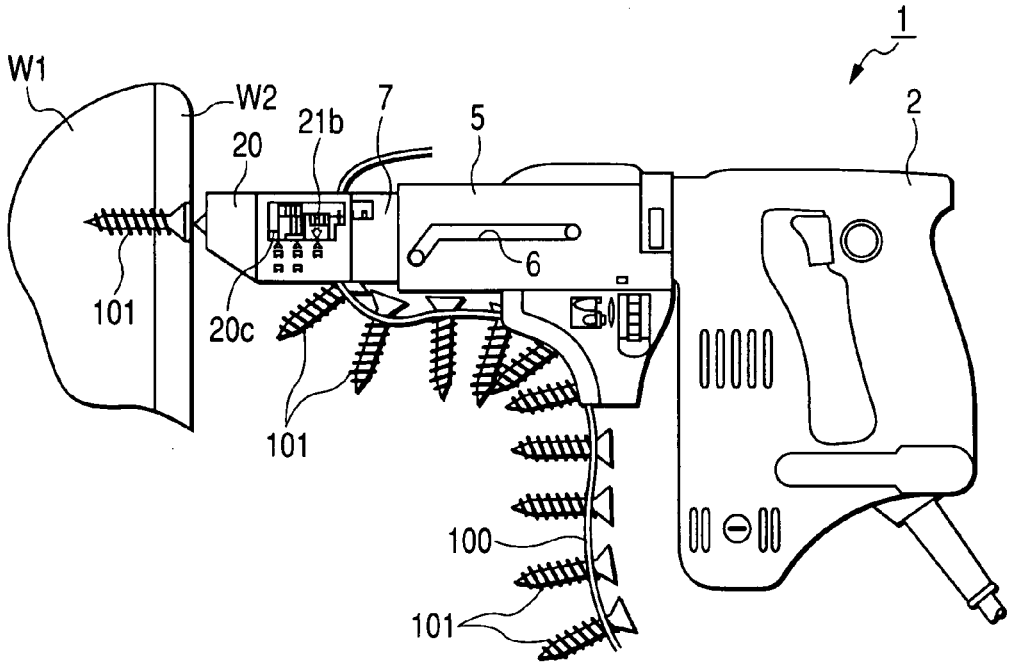
FIG. 1 is a side view showing a connected-screw driver according to a Mode of Embodiment 1 of the invention.
Figure 2:
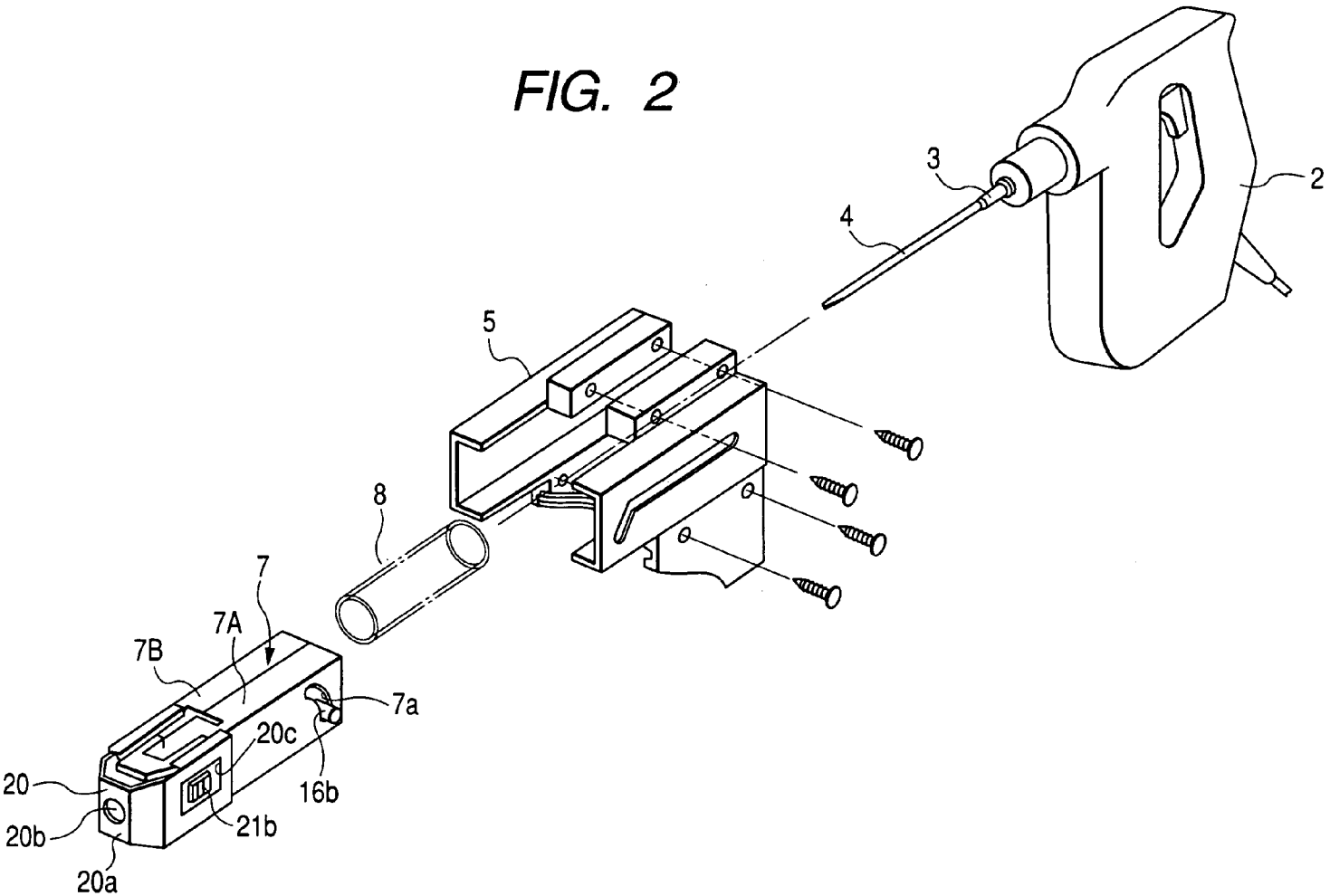
FIG. 2 is an exploded, perspective view showing the connected-screw driver according to the Mode of Embodiment 1 of the invention.
Figure 3:
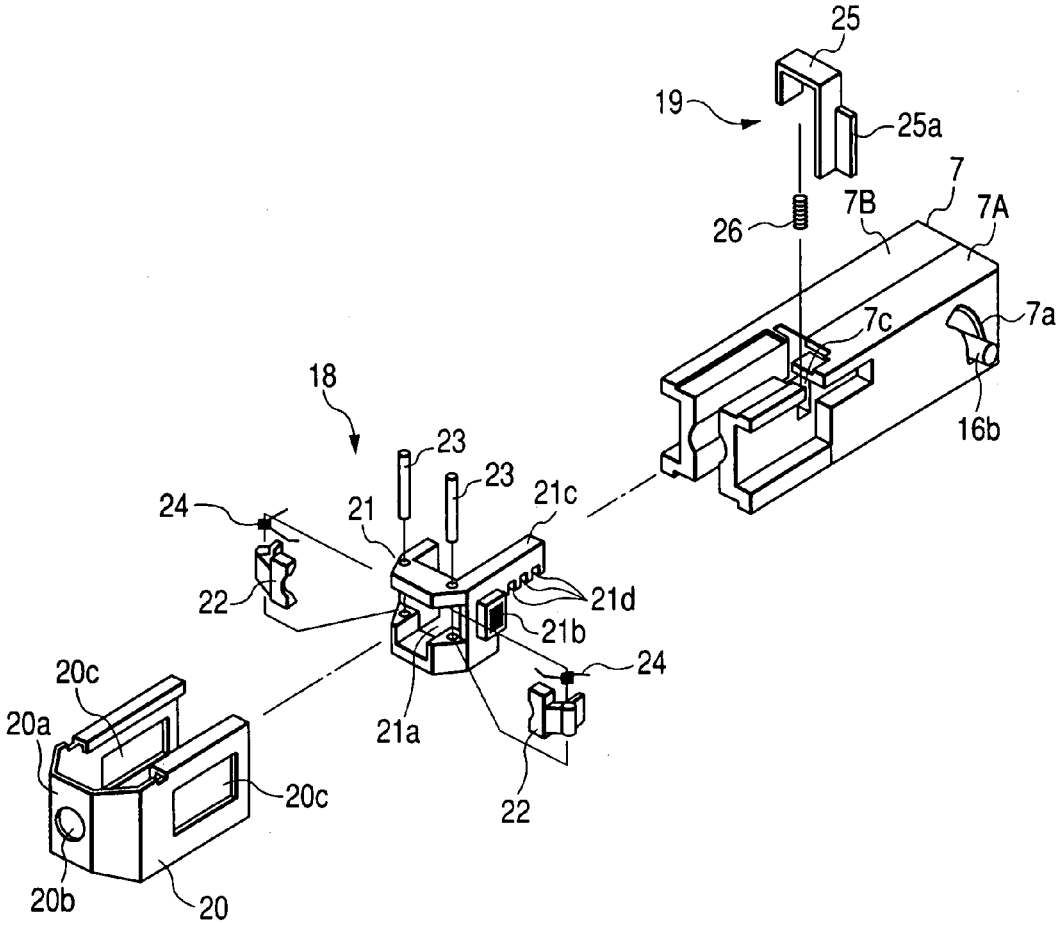
FIG. 3 is an exploded, perspective view showing a slider of the connected-screw driver according to the Mode of Embodiment 1 of the invention.
Figure 4:
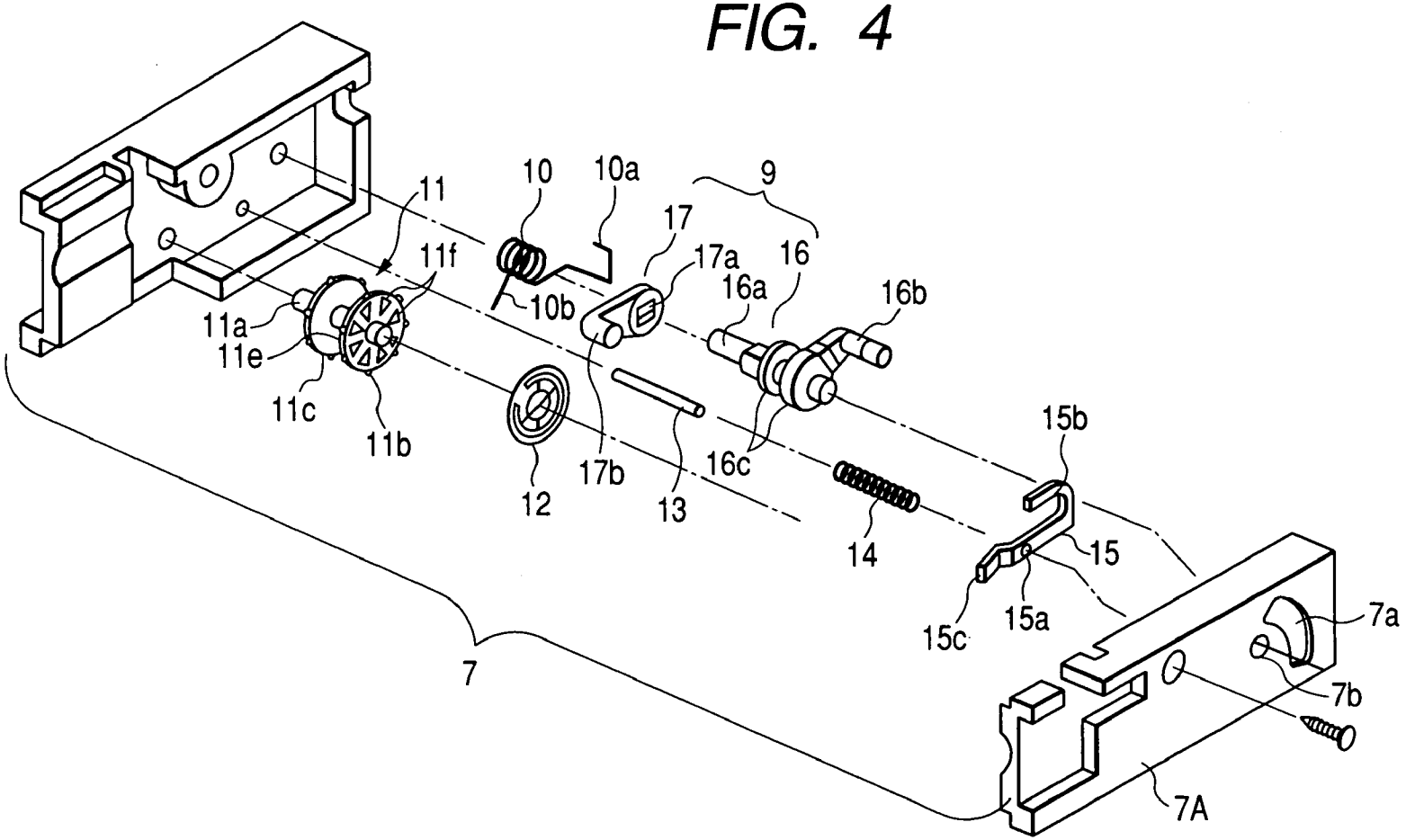
FIG. 4 is an exploded, perspective view showing a screw feed mechanism in the slider of the connected-screw driver according to the Mode of Embodiment 1 of the invention.
Figures 5A, 5B, 5C, 5D:
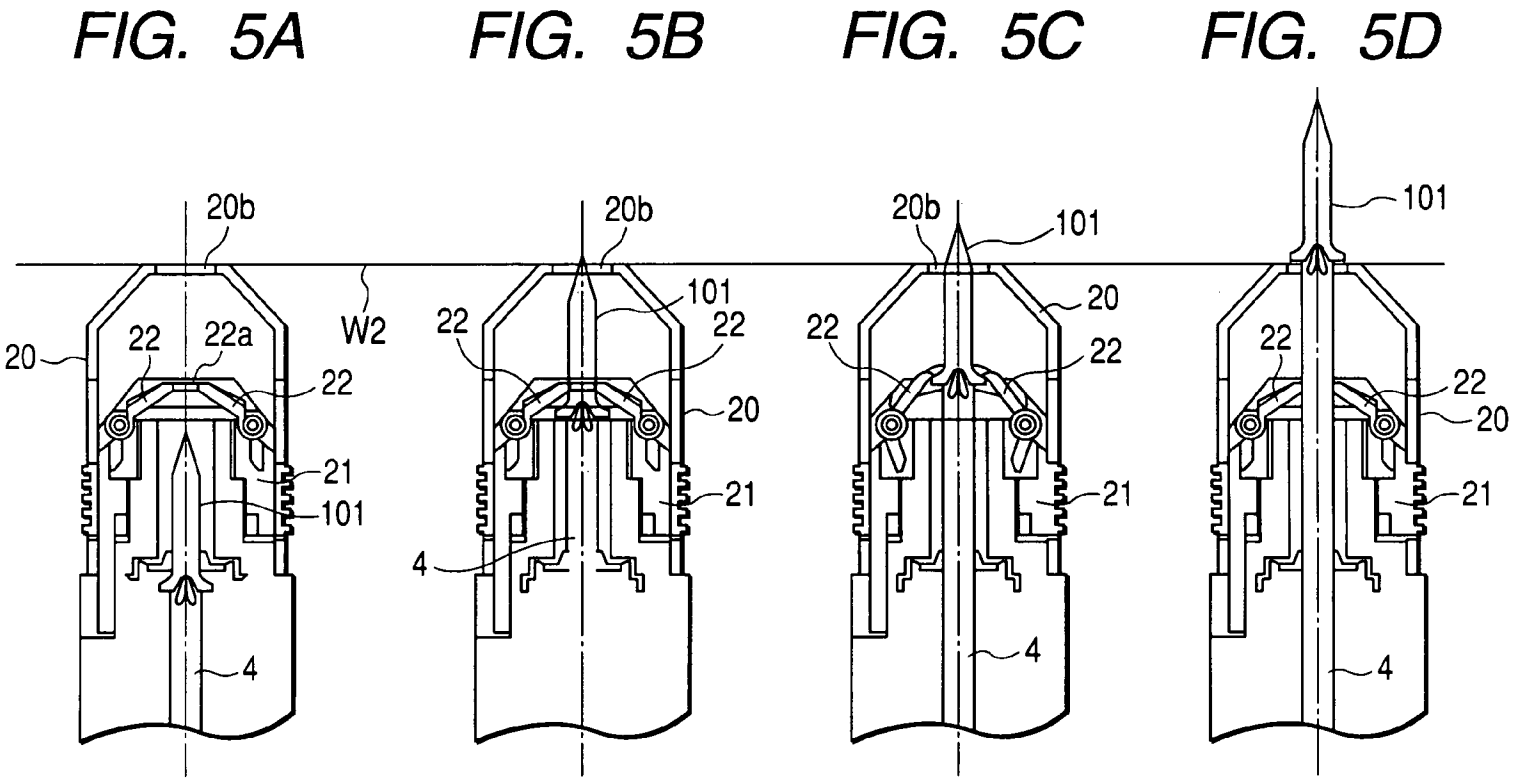
FIGS. 5A to 5D are partial sectional views illustrating the operation of a chuck mechanism of the connected-screw driver according to the Mode of Embodiment 1 of the invention.
Figure 6:
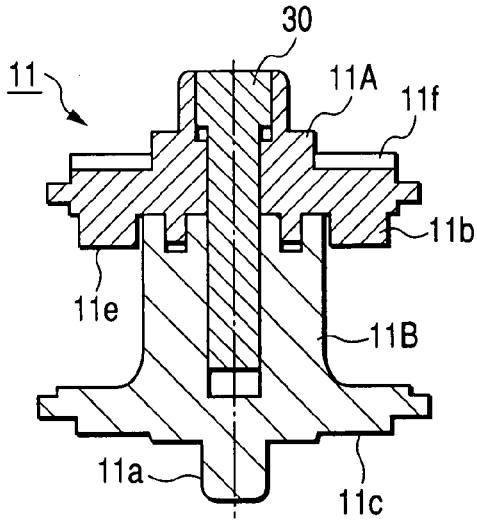
FIG. 6 is a sectional view showing a drum of the connected-screw driver according to the Mode of Embodiment 1 of the invention.

FIG. 1 is a side view of the connected-screw driver according to the present invention, FIG. 2 an exploded perspective of the same connected-screw driver, FIG. 3 an exploded perspective of a slider of the same connected-screw driver, FIG. 4 an exploded perspective showing the construction of a screw feed mechanism in the slider, FIGS. 5A to 5D partial sectional views for describing the operation of a chuck mechanism for the slider, FIG. 6 a sectional view of a drum, and FIGS. 7 to 11 partial bottom views in section for describing the operation of the screw feed mechanism.

In the connected-screw driver shown in FIG. 1, a reference numeral 2 denotes a housing, in which a motor constituting a driving power source (not shown) and an output shaft 3 (refer to FIG. 2) rotated by the motor are held. As shown in FIG. 2, a bit 4 is fixed to the output shaft 3. The housing 2, motor and output shaft 3 held in the interior thereof, and bit 4 attached to the output shaft 3 form a driver unit.

As shown in FIGS. 1 and 2, at a front end portion of the housing 2, a rectangular cylindrical slider case 5 is fixed, and a substantially lateral L-shaped guide slit 6 is formed in one side wall of the slider case 5. In the slider case 5, a slider 7 is fitted and held slidably, this slider 7 is urged constantly in one direction (in the leftward direction in FIG. 1) by a coiled spring 8 compressed between the slider 7 and slider case 5.

The details of the construction of the slider 7 will now be described on the basis of FIG. 3 and FIG. 4.

The slider 7 is formed of a unitary combination of left and right divisional members 7A, 7B as shown in FIG. 3. At a front end portion of the slider 7, a chuck mechanism 18 is held in a fitted state so that the chuck mechanism 18 can be moved longitudinally (axial direction of the bit 4), and a regulating mechanism 19 for regulating and fixing a longitudinal position of the chuck mechanism 18 is provided as well. At the slider 7, a metal front end member 20 molded to the shape of the letter "U" is held. A front end surface of the front end member 20 forms an engagement portion 20*a* engageable with a gypsum board W2 as a member to be tightened shown in FIG. 1. In the center of this engagement portion 20*a*, a bit hole 20*b* for inserting the bit 4 therethrough is formed. At both side portions of the front end member 20, rectangular openings (windows) 20*c* are formed.

The chuck mechanism 18 is a part for holding temporarily until a screw 101 which has come off during a screw tightening operation from a screw connecting belt 100 shown in FIG. 1 comes into engagement with a gypsum board W2 constituting a member to be tightened. The chuck mechanism 18 is provided with a base 21 fitted and held in the slider 7 so that the base 21 can be moved in the longitudinal direction.

The base 21 is provided in a central portion with an opening 21*a* extending longitudinally therethrough, in which at the opening 21*a*, a pair of chucks 22 are pivotably provided on both the left and right sides of a shaft of the bit 4 with the shaft held therebetween. The chucks 22 are engageable with the screw 101, and supported on shafts 23 so that the chucks 22 can be turned (opened) horizontally, the chucks 22 being urged in the closing direction by spiral coiled springs 24 wound the shafts 23. In the condition shown in FIG. 5A in which the screw 101 is not yet engaged with the left and right chucks 22, both of the chucks 22 are closed, and a circular hole 22*a* the inner diameter of which is slightly larger than the outer diameters of the screw 101 and bit 4 is formed between opposed portions of the chucks 22.

At both side portions of the base 21, projections 21*b* are formed, which are opposed to the openings 20*c* formed in the front end member 20 as shown in FIGS. 1 and 2.

The base 21 is provided at one side portion thereof with an engagement member 21*c* extending rearward in the horizontal direction, and three groove type engagement recesses 21*d* are formed in this engagement member 21*c* so that the engagement recesses 21*d* are spaced longitudinally at suitable intervals.

On the other hand, the slider 7 is provided in one side portion thereof with an engagement recess 7*c*, in which an inverted U-shaped operating member 25 is fitted and held vertically movably. This operating member 25 is provided on one side portion thereof with a rectangular plate type engagement projection 25*a* which is made integral with the operating member 25, and which is adapted to be engaged selectively with one of the three engagement recesses 21*d* formed in the engagement member 21*c* of the base 21. The operating member 25 is urged upward constantly (in the direction in which the engagement projection 25*a* comes into engagement with the engagement recesses 21*d*) by a coiled spring 26.

Thus, the engagement recesses 21*d* formed in the base 21, operating member 25 on which the engagement projection 25*a* is formed and coiled spring 26 form the regulating mechanism 19 mentioned above.

The details of the construction of the screw feed mechanism contained in the slider 7 will now be described on the basis of FIG. 4.

As shown in FIG. 4, the slider 7 holds in an inner portion thereof an arm portion 9, a coiled spring 10, a drum 11, a plate spring member 12, a shaft member 13, a coiled spring 14 and a stopper plate 15. One divisional member 7A of the slider 7 is provided with an arcuate elongated hole 7*a*.

The arm 9 includes a shaft arm 16 and a clutch arm 17. The shaft arm 16 has a shaft 16*a* supported on another shaft parallel to a rotary shaft 11*a* of a drum 11 so that the shaft 16*a* can be turned, and a guide arm 16*b* extending from the shaft 16*a* to the guide slit 6 of the slider case 5 and engaged at one end with the guide slit 6.

The clutch arm 17 is a member extending from the shaft 16*a* of the shaft arm 16 to the drum 11, and a rectangular hole 17*a* formed in one end portion of the clutch arm 17 is fitted relatively unrotatably around the shaft 16*a* of the shaft arm 16. The other end portion of the clutch arm 17 extends to the drum 11, and a pin type engagement projection 17*b* is formed at the same end portion.

The drum 11 is a cylindrical member supported via a shaft on the slider 7 so that the drum 11 can be turned, and two disc type flanges 11*b*, 11*c* are formed on the rotary shaft 11*a* in an axially spaced manner. The outer circumferential portions of each of the flanges 11*b*, 11*c* is provided with a plurality of projections 11*d* (refer to FIG. 7) engaged with a screw connecting belt 100 shown in FIG. 1. The screw connecting belt 100 has a plurality of screws 101 inserted and held therein at equal intervals. The screw connecting belt 100 is provided in both of widthwise edge portions thereof with a plurality of engagement recesses, with which the projections 11*d* formed on the outer circumferences of the two flanges 11*b*, 11*c* of the drum 11, at equal intervals in the lengthwise directions of the screw connecting belt 100.

One flange 11*b* of the drum 11 is provided (refer to FIG. 7) with a ratchet 11*e* on an inner surface (surface opposed to the other flange 11*c*) thereof, and a plurality of engagement recesses 11*f* in an outer surface (surface opposite to the surface on which the ratchet 11*e* is formed) of the same flange 11*b*. The corrugated plate spring member 12 mentioned above and fixed to an inner wall of the slider 7 (divisional member 7A) is engaged in a recessed and projecting state with the engagement recess 11*f*.

As shown in FIG. 6, the drum 11 is made by combining in one body by bolts divisional members 11A, 11B obtained by dividing the drum 11 into two in the axial direction. One divisional member 11A is made of a metal, such as SUS, and the other 11B a resin. The ratchet 11*e* mentioned above is formed on the inner surface of the metal divisional member 11A.

As shown in FIG. 4, the stopper plate 15 is a member extending from the shaft 16*a* of the shaft arm 16 to the ratchet 11*e* of the drum 11, and molded to the shape of the letter of laterally extending "L", an intermediate portion of the stopper plate 15 being supported pivotably on the slider 7 via the shaft member 13. The shaft member 13 is provided in the position halfway between the shaft arm 16 and drum 11 in the longitudinal direction which is between the left and right divisional members 7A, 7B of the slider 7. The stopper plate 15 is supported pivotably owing to the shaft member 13 inserted through a circular hole 15*a* formed in the stopper plate 15.

The stopper plate 15 is molded like a hook at one end portion thereof 15*b*, which is fitted between both of the flanges 16*c* of the shaft 16*a* of the shaft arm 16 and thereby connected to the shaft 16*a*. The other end portion of the stopper plate 15 forms an engagement section 15*c* engaged with and disengaged from the ratchet 11*e* formed on the flange 11*b* of the drum 11. This stopper plate 15 is urged axially (in the direction in which the engagement section 15*c* comes into engagement with the ratchet 11*e* of the drum 11) by the coiled spring 14 inserted through the shaft member 13.

The clutch arm 17 is urged axially with the shaft arm 16 by the coiled spring 10 inserted through the shaft 16*a* of the shaft arm 16, and an engagement projection 17*b* formed at an end portion of the clutch arm 17 is pressed by and engaged with the ratchet 11*e* of the drum 11. The coiled spring 10 is engaged at a C-shaped one end portion 10*a* with the guide arm 16*b* of the shaft arm 16, and at the other end portion 10*b* with one divisional member 7B, and has both the function of urging the shaft arm 16 and clutch arm 17 in the axial direction as mentioned above and the function of urging the shaft arm 16 so that the guide arm 16*b* presses the shaft arm 16 to cause the shaft arm 16 to come into engagement with the guide slit 6 of the slider case 5.

Figure 7:
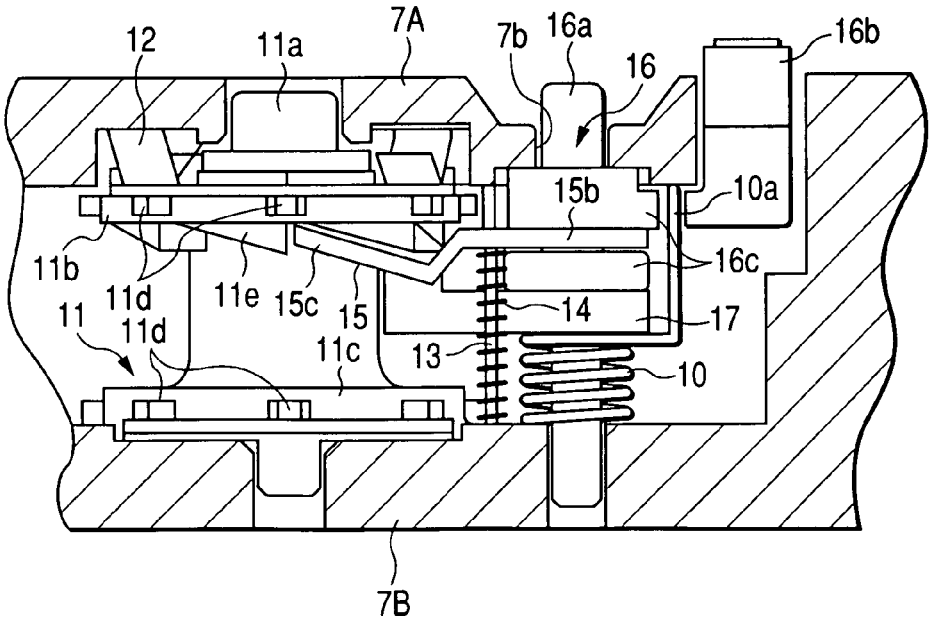
FIG. 7 is a partial bottom view illustrating, in section, the operation (an initial state) of the screw feed mechanism of the connected-screw driver according to the Mode of Embodiment 1 of the invention.

As shown in FIG. 7, the shaft 16*a* of the shaft arm 16 projects at a free end portion outward from the circular hole 7*b* formed in the divisional member 7A.

The operation of the connected-screw driver 1 having this construction will now be described.

For example, in an operation for fixing the gypsum board W2 to the ground member W1 shown FIG. 1 by screwing, the engagement portion of the free end member of the connected-screw driver 1 in an initial state is pressed against the gypsum board W2. As a result, the slider 7 is pushed into the interior of the slider case 5 against the urging force of the coiled spring 8, and, in accordance with this action, the shaft arm 16 is turned around the shaft 16*a* as shown in FIG. 7.

Figure 8:
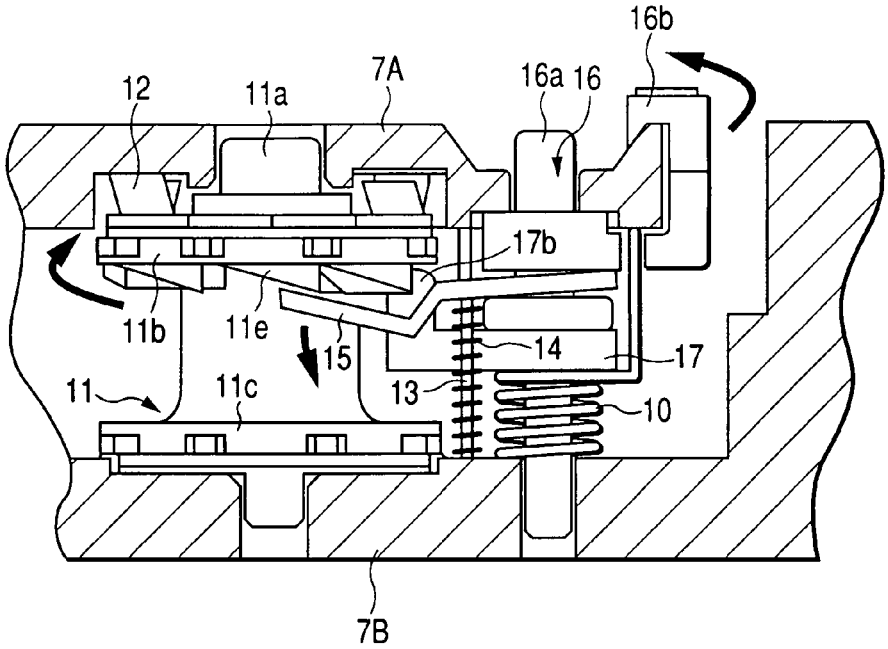
FIG. 8 is a partial bottom view illustrating, in section, the operation (during screw feeding) of the screw feed mechanism of the connected-screw driver according to the Mode of Embodiment 1 of the invention.

Since the guide arm 16*b* of the shaft arm 16 held in the slider 7 is moved slidingly along the guide slit 6 (refer to FIGS. 1 and 2) of the slider case 5, the shaft arm 16 is turned at a predetermined angle in the direction of an arrow in FIG. 8, and the clutch arm 17 inserted into and fitted to the shaft portion 16*a* thereof is also turned together in one body in the same direction. Owing to the turning of this clutch arm 17, the latchet 11*e* is engaged with the engagement projection 17*b* of the clutch arm 17, and the drum 11 is turned in the direction of the arrow in FIG. 8 to cause the screw connecting belt 100 engaged with the two flanges 11*b*, 11*c* of the drum 11 to be fed intermittently by a predetermined quantity at a time, so that the screws 101 held on the screw connecting belt 100 are fed one by one. During this time, the stopper plate 15 is pressed by a gently inclined surface of the latchet 11*e* of the drum 11 and thereby turned in the direction of the arrow in FIG. 8 to allow the rotation of the drum 11.

When the screws 101 are fed out in the above-described manner, the screw 101 positioned on the axis of the bit 4 of the driver unit is pushed out by the bit 4 and disengaged from the screw connecting belt 100. The screw 101 which has just disengaged from the screw connecting belt 100 is temporarily held on the chuck mechanism 18 until the screw 101 has been engaged with the gypsum board W2. The operation of the chuck mechanism 18 will now be described on the basis of FIGS. 5A to 5D.

The screw which has just disengaged from the screw connecting belt 100 is pushed out forward as shown in FIG. 5A by the bit 4 in accordance with a rearward movement of the slider 7. When the free end of the screw 101 comes into engagement with the left and right chucks 22 of the chuck mechanism 18, the screw 101 is temporarily held by the chucks 22 as shown in FIG. 5B, and the free end of the screw 101 is pressed against the gypsum board W2.

Figure 9:
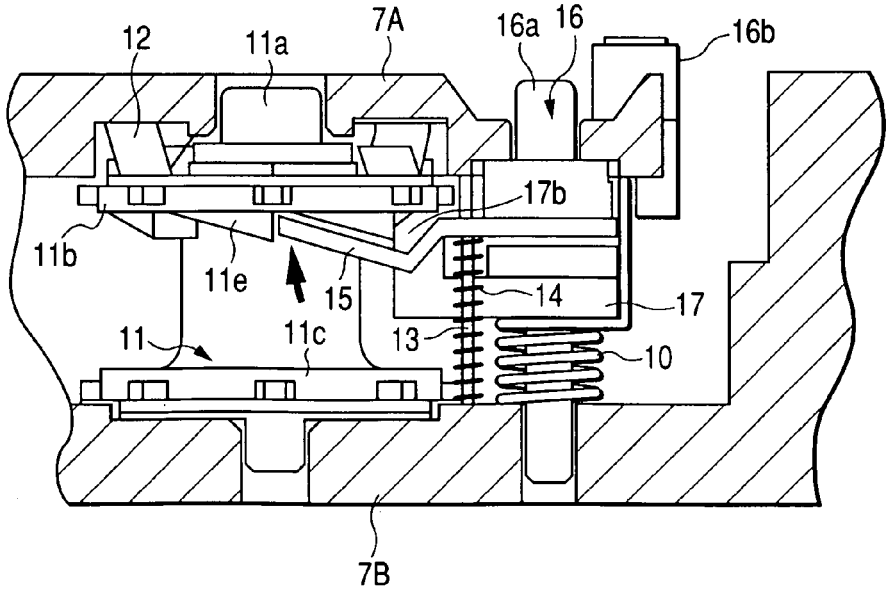
FIG. 9 is a partial bottom view illustrating, in section, the operation (screw feeding is completed) of the screw feed mechanism of the connected-screw driver according to the Mode of Embodiment 1 of the invention.

When the screw 101 in this condition is driven into the gypsum board W2 by the bit 4 rotated by a motor (not shown), the chucks 22 are pushed open by a head portion of the screw 101 as shown in FIG. 5C, and the head portion of the screw 101 passes through the gypsum board W2. Finally, the screw 101 is driven into the gypsum board W2 as shown in 5(*d*) to fix the gypsum board W2 to the ground member W1. During this time, the engagement portion 15*c* of the stopper plate 15 comes into engagement with the ratchet 11*e* of the drum 11 as shown in FIG. 9, and thereby prevents a reverse rotation of the drum 11.

Figure 10:
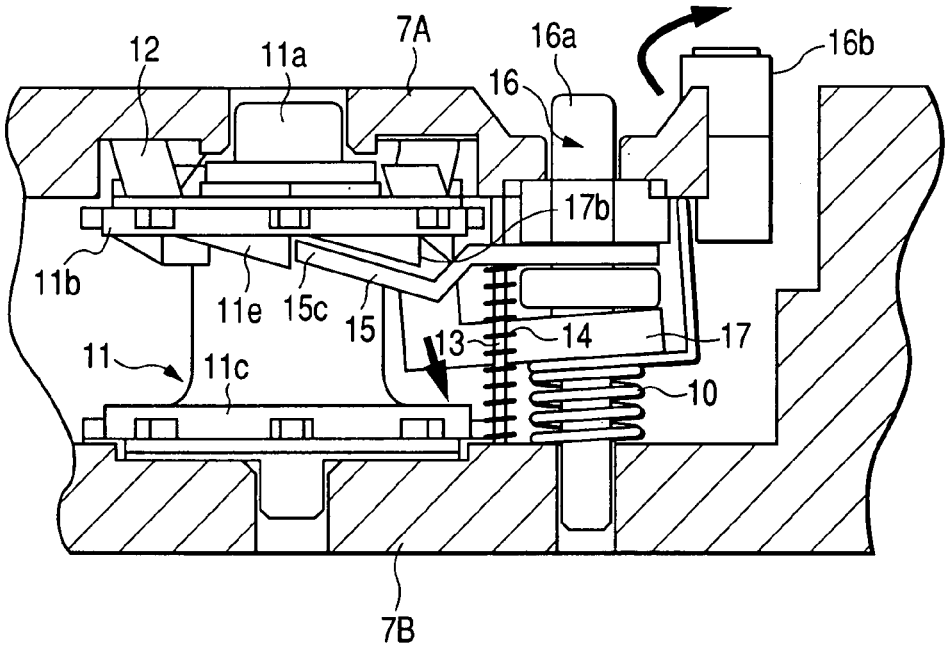
FIG. 10 is a partial bottom view illustrating, in section, the operation (returned to the initial state) of the screw feed mechanism of the connected-screw driver according to the Mode of Embodiment 1 of the invention.

When the connected-screw driver 1 is disengaged from the gypsum board W2, the slider 7 is slidingly moved in the interior of the slider case 5 by the urging force of the coiled spring 8, and returned to the initial position. The action of this slider 7 causes the shaft arm 16 and clutch arm 17 to be turned reversely as shown in FIG. 10. However, since these turning movements are not transmitted to the drum 11, the feeding out of the screw connecting belt 100 and screw 101 is not done. Namely, the engagement portion 15*c* of the stopper plate 15 is engaged with the ratchet 11*e* of the drum 11 and prevent a reverse rotation of the drum 11. The clutch plate 17 is turned in the direction of the arrow in FIG. 10 since the engagement projection 17*b* is pressed against the surface of a gentler inclination of the ratchet 11*e* of the drum 11, so that the engagement projection 17*b* is turned in the direction of the arrow in FIG. 10. This causes the engagement of the engagement portion 15*c* of the stopper plate 15 to be released from the ratchet 11*e*, so that the rotation thereof is not transmitted to the drum 11.

The screw connecting belt 100 is fed intermittently by repeating the above-mentioned operations, and the screws 101 connected to the screw connecting belt 100 are fed one by one and driven into the gypsum board W2 in order. The gypsum board W2 is thereby fixed to the ground member W1 with a plurality of screws 101.

Figure 11:
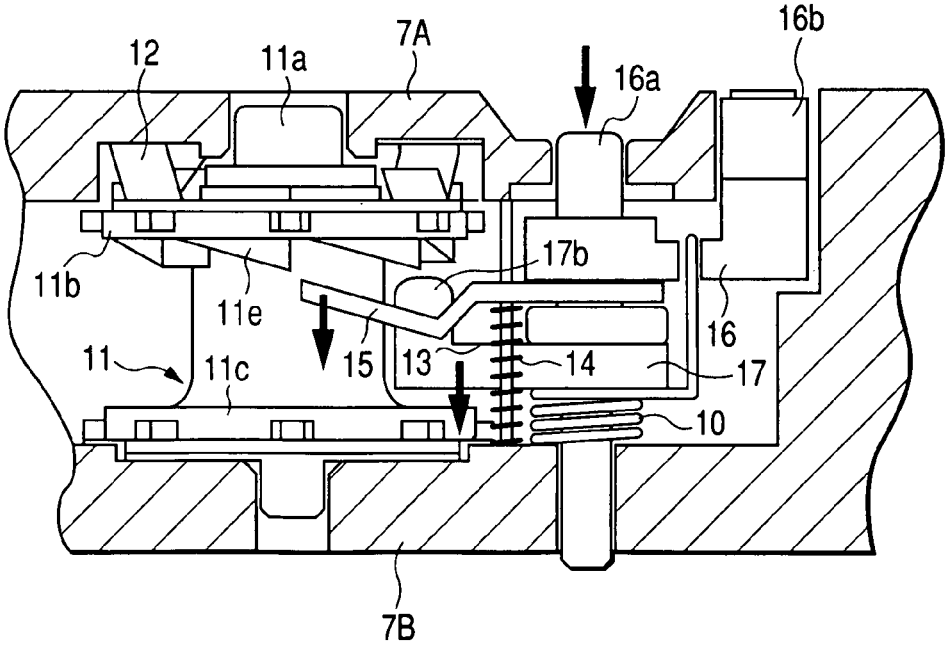
FIG. 11 is a partial bottom view illustrating, in section, the operation (a state, in which reverse rotation of the drum is possible) of the screw feed mechanism of the connected-screw driver according to the Mode of Embodiment 1 of the invention.

When the shaft 16*a* of the shaft arm 16 is pushed and thereby move the shaft arm 16 in the axial direction (direction of an arrow in FIG. 11) against the urging force of the coiled spring 10 as shown in FIG. 11, the clutch arm 17 and stopper plate 15 are also moved in the same direction, the engagement of these two parts with the ratchet 11*e* being released. Therefore, the drum 11 can be turned freely in the direction in which the screw connecting belt 100 is fed and in the direction opposite thereto. Accordingly, even when the screw connecting belt 100 is excessively fed, the screw connecting belt 100 can be turned in the reverse direction, so that the operation efficiency of the connected-screw driver 1 is heightened.

In this mode of embodiment of the screw-connected driver 1, the screw 101 which has just come off from the screw connecting belt 100 and in an unstable state is held temporarily in the chuck mechanism 18 as described above, until the screw 101 comes into engagement with the gypsum board W2. Since screw 101 is tightened after the behavior of the screw 101 becomes stable, the inconvenience, such as the deviation of the screw from a tightening position, and the diagonal tightening of the screw 101 are prevented. This enables the screw to be tightened always in a predetermined tightening position, and the screw tightening finishing condition to be improved.

In order to obtain the above-described effect with respect to screws 101 of different lengths, it is necessary that a screw which has just come off from the screw connecting belt 101 be held thereon until the screw 101 engages with the gypsum board W2. In order to meet this purpose, the position of the chuck mechanism 18 in longitudinal direction has to be regulated in accordance with the length of the screw 101. Concretely speaking, the position of the chuck mechanism 18 needs to be shifted forward (leftward in FIG. 1) as the length of the screw 101 increases.

In view of the circumstances, the mode of this embodiment is formed so that the position of the chuck mechanism 18 in the longitudinal direction can be regulated in three stages by the regulating mechanism 19. The positions in the chuck mechanism 18 in the longitudinal direction are fixed by engaging the engagement projection 25*a* of the operating member 25 of the regulating mechanism 19 with one of the three engagement recesses 21*d*. The regulation of the position of the chuck mechanism 18 in the longitudinal direction is made in the following manner.

That is, when the operating member 25 of the regulating mechanism 19 is pushed down against the upward bias of the coiled spring 26, engagement of the engagement projection 25*a* of the operating member 25 with the engagement recess 21*d* of the base 21 is released, so that by operating the projection 21*b* of the base 21, which faces the opening 20*c* of the front end member 20, in this state to move the chuck mechanism 18 forward and backward to engage the engagement projection 25*a* of the operating member 25 with the engagement recess 21*d* of the base 21, a position of the chuck mechanism 18 is adjusted in the longitudinal direction and the chuck mechanism 18 is fixed in the position. In addition, according to the embodiment, lengths of screws 101 are classified into three groups of 20 to 28 mm, 30 to 38 mm, and 40 mm or longer, and a position of the chuck mechanism 18 is adjusted according to the respective groups. In this case, a position of the chuck mechanism 18 in the longitudinal direction can be distinguished by arrows, which are marked on the projection 21*b* of the base 21, and fixed by moving the chuck mechanism 18 in the longitudinal direction so that the arrows agree with the respective positions.

Also, according to the embodiment, the chucks 22 of the chuck mechanism 18 abuts against a screw 101 to turn (open) against the bias of the spiral coiled springs 24 whereby a distance between the chucks 22 is varied automatically, thereby enabling holding the screws 101 having different thread diameters and thread head diameters to stabilize the same in behavior.

<Mode of Embodiment 2>

Subsequently, an embodiment of the invention will be described with reference to FIGS. 12, 13A, and 13B.

Figure 12:
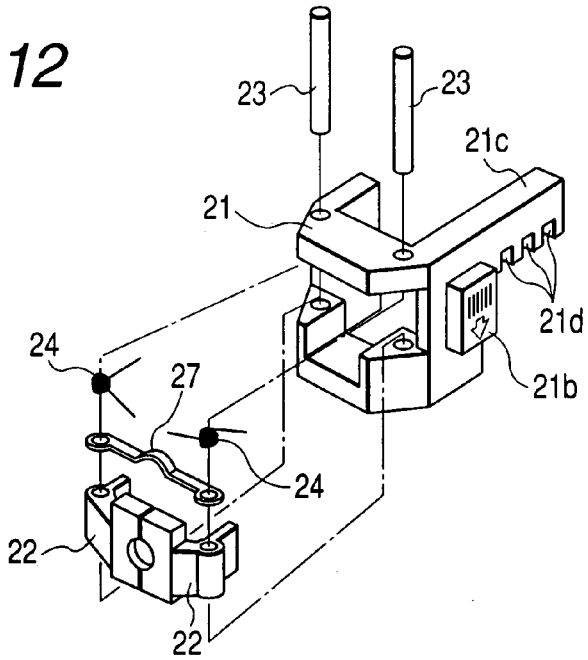
FIG. 12 is an exploded, perspective view showing a chuck mechanism of a connected-screw driver according to a Mode of Embodiment 2 of the invention.
Figure 13A:
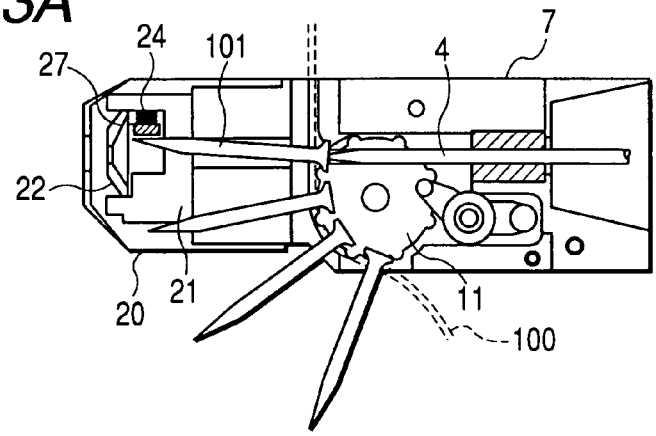
FIG. 13A is a partial sectional view illustrating the operation of a chuck mechanism of the connected-screw driver according to the Mode of Embodiment 2 of the invention.
Figure 13B:
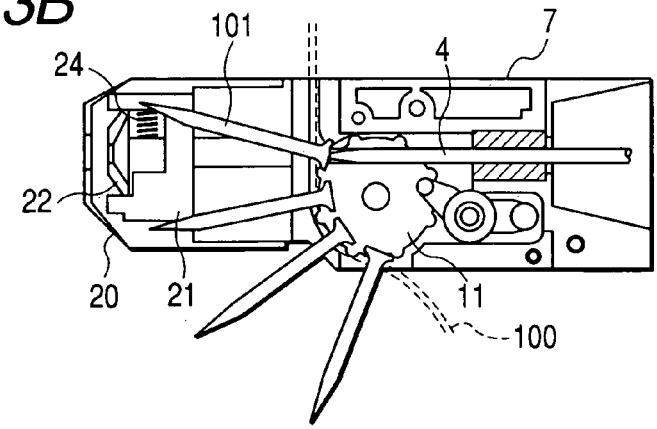
FIG. 13B is a partial sectional view illustrating the operation of a chuck mechanism (a chuck mechanism without any screw fall preventing plate) according to a further embodiment.

FIG. 12 is a perspective view showing a chuck mechanism of a connected-screw driver according to the Mode of Embodiment, FIG. 13A is a partial sectional view showing an operation of the chuck mechanism according to the Mode of Embodiment, and FIG. 13B is a partial sectional view showing an operation of a chuck mechanism (a chuck mechanism without a screw fall preventing plate) according to a further Mode of Embodiment. In addition, the same members in FIGS. 12 and 13 as those in the Mode of Embodiment 1 are denoted by the same reference numerals as those in the latter, and an explanation therefor is omitted hereinbelow.

The present embodiment has a feature in that a screw fall preventing plate 27 is mounted horizontally on shafts 23, which pivotally support left and right chucks 22 as shown in FIGS. 12 and 13A, and is the same in other construction as the Mode of Embodiment 1.

Here, the screw fall preventing plate 27 is arranged above the chucks 22 and between the chucks 22 and spiral coiled springs 24.

Thus, without the screw fall preventing plate 27, there is a possibility that a screw 101 fed by a screw connecting belt 100 greatly gets out of the chucks and cannot be held by the chucks 22.

In contrast, according to the present embodiment, even when a screw 101 tries to greatly get out of the chucks, the screw 101 abuts against the screw fall preventing plate 27 to be restricted in movement as shown in FIG. 13A, so that the screw does not greatly get out of the chucks. As a result, the screw 101 is surely held by the chucks 22 at all times whereby a stable work of screwing is performed. Besides, the same effect as that in the Mode of Embodiment 1 is produced also in the present embodiment.

What is claimed is:

1. A connected-screw driver having a driver unit provided with a motor, an output shaft rotated by the motor, a housing adapted to house these motor and output shaft, and a bit fixed to the output shaft, a slider case fixed to the housing so that the bit is inserted therethrough, and a slider provided in the slider case so that the slider can be moved reciprocating therein; an engagement member adapted to be engaged with a member to be tightened; and adapted to feed the connected screws in accordance with the reciprocating movements of the slider, characterized in that:

the slider is provided with a chuck mechanism, which is adapted to temporarily retain a screw, which has come off from the screw connecting belt, until the screw has been engaged with the member to be tightened, in such a manner that the slider can be moved in the axial direction of the bit; and a regulating mechanism adapted to regulate and fix a position of the chuck mechanism in the axial direction of the bit.

2. The connected-screw driver according to claim 1, wherein the chuck mechanism is formed so as to include a base held on the slider so that the base can be moved in the axial direction of the bit, a pair of chucks engageable with a screw and provided pivotably on both sides of the axis of the bit, and a first elastic member urging each chuck in the direction in which the chucks engage with screws.

3. The connected-screw driver according to claim 2, wherein the chuck mechanism is provided with fall of screw preventing plates on the portions of the chuck mechanism which are adjacent to the chucks thereof.

4. The connected-screw driver according to claims 2 wherein the regulating mechanism is formed so as to include an operating member supported on the slider so that the operating member can be reciprocating moved, and having an engagement projection engageable selectively with one of a plurality of engagement recesses formed in the base of the chuck mechanism, and a second urging member adapted to urge the operating member in the direction in which the engagement projection of the operating member comes into engagement with one of the engagement recess of the base.

* * * * *